US009351582B2

(12) United States Patent
Boccara

(10) Patent No.: US 9,351,582 B2
(45) Date of Patent: May 31, 2016

(54) SOFA PROVIDED WITH A SENSOR

(71) Applicant: Patrice Boccara, Nogent sur Marne (FR)

(72) Inventor: Patrice Boccara, Nogent sur Marne (FR)

( * ) Notice: Subject to any disclaimer, the term of this patent is extended or adjusted under 35 U.S.C. 154(b) by 0 days.

(21) Appl. No.: 14/255,258

(22) Filed: Apr. 17, 2014

(65) Prior Publication Data

US 2014/0319892 A1 Oct. 30, 2014

(30) Foreign Application Priority Data

Apr. 29, 2013 (FR) ..... 13 00992

(51) Int. Cl.

| | |
|---|---|
| ***A47C 17/04*** | (2006.01) |
| ***A47C 20/00*** | (2006.01) |
| ***A47C 7/38*** | (2006.01) |
| ***A47C 20/04*** | (2006.01) |

(52) U.S. Cl.

CPC . *A47C 17/04* (2013.01); *A47C 7/38* (2013.01); *A47C 20/041* (2013.01)

(58) Field of Classification Search

CPC .... A47C 17/04; A47C 20/041; A47C 27/083; A47C 31/126

See application file for complete search history.

(56) References Cited

U.S. PATENT DOCUMENTS

| | | | | |
|---|---|---|---|---|
| 4,707,788 | A * | 11/1987 | Tashiro et al. | 701/49 |
| 5,082,326 | A * | 1/1992 | Sekido | B60N 2/4415 297/284.6 |
| 5,176,424 | A * | 1/1993 | Tobita et al. | 297/284.1 |
| 6,490,515 | B1 * | 12/2002 | Okamura et al. | 701/49 |
| 7,163,263 | B1 * | 1/2007 | Kurrasch et al. | 297/217.3 |
| 7,823,972 | B2 * | 11/2010 | Browne et al. | 297/217.2 |
| 8,820,782 | B2 * | 9/2014 | Breed | B60J 10/00 180/273 |
| 2004/0056520 | A1 * | 3/2004 | Cho | 297/218.1 |
| 2005/0264069 | A1 * | 12/2005 | Makhsous | A47C 17/163 297/284.1 |
| 2007/0246979 | A1 * | 10/2007 | Browne et al. | 297/216.12 |
| 2008/0007103 | A1 * | 1/2008 | Welles | A61B 5/11 297/330 |
| 2009/0152916 | A1 * | 6/2009 | Lin et al. | 297/217.3 |
| 2009/0273441 | A1 * | 11/2009 | Mukherjee | 340/5.82 |
| 2010/0231421 | A1 * | 9/2010 | Rawls-Meehan | 341/20 |
| 2012/0032487 | A1 * | 2/2012 | Yamaguchi et al. | 297/354.1 |
| 2014/0379224 | A1 * | 12/2014 | Hyde et al. | 701/49 |

FOREIGN PATENT DOCUMENTS

| | | | |
|---|---|---|---|
| CN | 201550961 U | * | 8/2010 |
| CN | 204318120 U | * | 5/2015 |
| FR | 2 682 499 A1 | | 4/1993 |

OTHER PUBLICATIONS

French Search Report (FR 1300992) (2 pages—dated Dec. 3, 2013).

* cited by examiner

*Primary Examiner* — Elizabeth A Quast

(74) *Attorney, Agent, or Firm* — Renner, Kenner, Greive, Bobak, Taylor & Weber

(57) ABSTRACT

A piece of furniture which is used to sit on which includes a seating part at least one element, distinct from the seating part, which can go between a position of use of the element and a position of non-use of the element and a control means designed to command the passage of the at least one element from one position to another. The piece of furniture further includes a sensor means designed to detect the presence of a person seated on the seating part; and the piece of furniture is arranged such that the control means command the passage of the at least one element from one position to another when the sensor means detects the presence of a person on the seating part.

14 Claims, 2 Drawing Sheets

SOFA PROVIDED WITH A SENSOR

The present invention relates to a piece of furniture which is used to sit on or to stretch oneself out on, in particular an armchair, a seat, a sofa, a bed or the like, comprising an element, in particular a headrest, which can go between two positions and/or two states, as well as an assembly comprising a piece of furniture which is used to sit on or to stretch oneself out on, in particular an armchair, a seat, a sofa, a bed or the like, and an element which can go between two positions and/or two states, the element being distinct from the piece of furniture, for example the element being able to be a door of a television unit, spaced from the sofa, a television, a sound system, a door of a bar, a movable table etc.

BACKGROUND ART

Sofas are already known in the prior art comprising a headrest which is fitted such as to be able to pivot between two or more positions, in particular a lowered position and a raised position, in which it supports the head of the person seated on the sofa. It is also known to provide a system to control the displacement of the headrest between the two, raised and lowered positions, i.e. an electric system which controls the activation/deactivation of an electric motor which drives a mechanical system connected to the headrest. When the user wants to put the headrest into the position in which it supports his head, he commands the activation of the motor, in particular by means of control buttons, thus rotating the headrest until it reaches the required raised position. These sofas according to the prior art are quite complicated to use, and, in particular, each time the user sits down, he has to adjust the headrest to the appropriate position he wants, in particular by keeping a button pressed down, then, when he leaves the sofa, he has to lower the headrest to its lowered or rest position, in order to prevent the mechanical system connected to the headrest from being damaged by one impact or another, since when the headrest is in the raised position, the mechanical system is not protected as securely as when it is in the lowered position. In fact, in the lowered position, the mechanical system for displacement of the headrest does not appear on the exterior, and is therefore protected.

DISCLOSURE OF THE INVENTION

The object of the present invention is to eliminate the disadvantages of the prior art, by proposing a piece of furniture which is used to sit on or to stretch oneself out on. In particular, the present invention relates to an armchair, a seat, a bed or a sofa, which eliminates the disadvantages of the prior art, and in particular is very simple to use. More particularly, the present invention relates to a system for control of an element which can assume two positions or states, for example the system for displacement of a headrest.

According to the invention, the piece of furniture which is used to sit on or to stretch oneself out on, is in particular an armchair, a chair, a bed or a sofa.

However, whilst remaining within the same inventive concept, the element which can assume two different states or positions need not form part of the piece of furniture, and can be distinct from it.

The present invention also relates to an assembly comprising a piece of furniture and an element.

The said one element, which in this case does not form part of the piece of furniture, can be for example a cupboard door, a screen which is fitted such as to slide, a table fitted such as to be mobile which is displaced automatically in order to assume a position appropriate for its use by the person seated on the piece of furniture, but it can also be a television, a sound system, an air conditioning system or the like, which is changed from an inactive state to an active state.

BRIEF DESCRIPTION OF THE DRAWINGS

By way of example, a description is now provided of preferred embodiments of the invention, with reference to the drawings, in which.

PREFERRED EMBODIMENT FOR CARRYING OUT THE INVENTION

Figure 1:
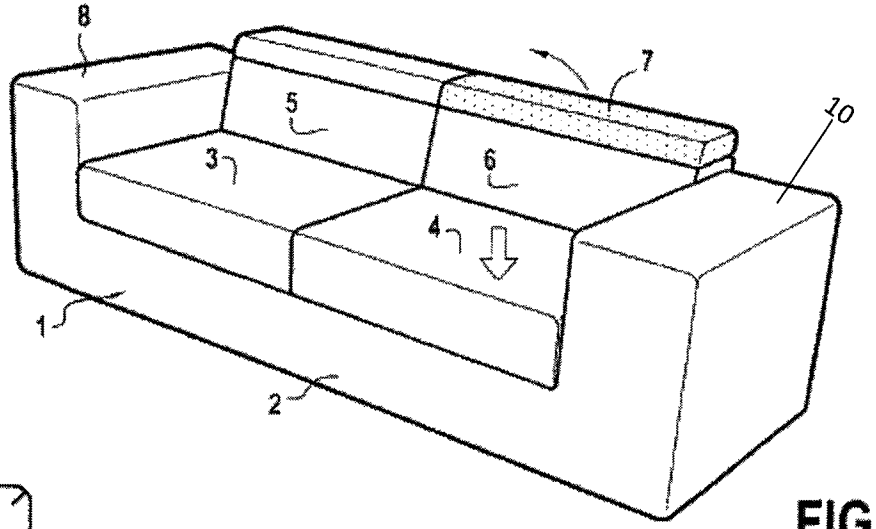
FIG. 1 is a view in perspective of a sofa according to the invention.
Figure 2:
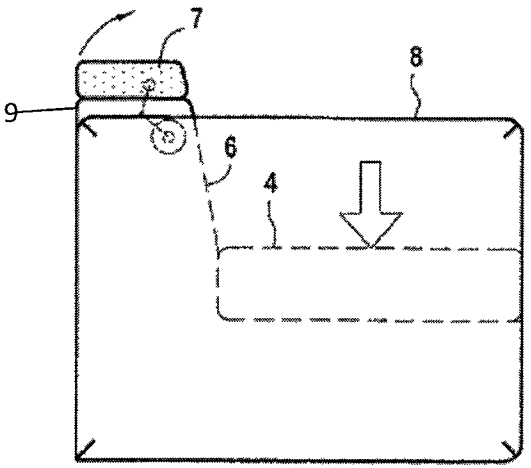
FIG. 2 is a lateral view of the sofa in FIG. 1.
Figure 3:
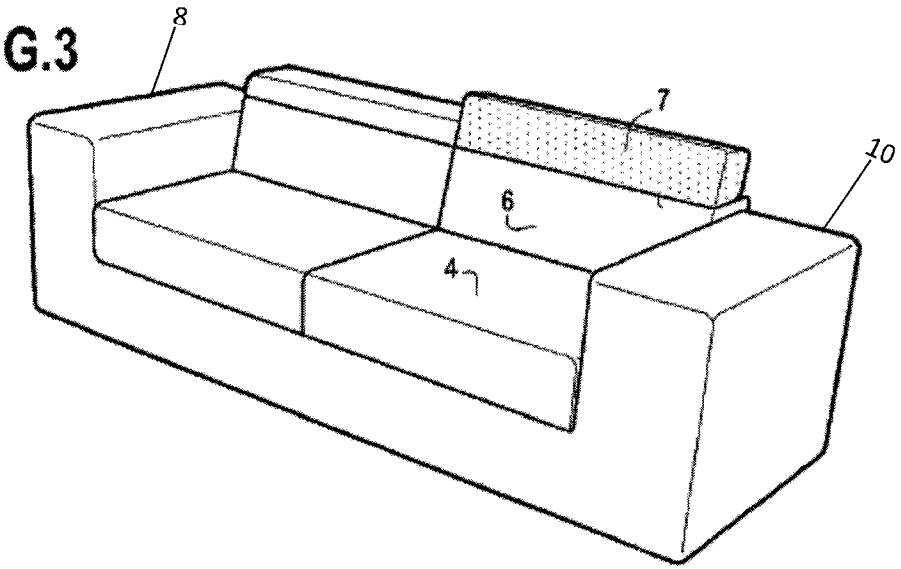
FIG. 3 is a view in perspective of the sofa in FIG. 1, in the case when a person is getting up from the seat in order to leave it.
Figure 5:
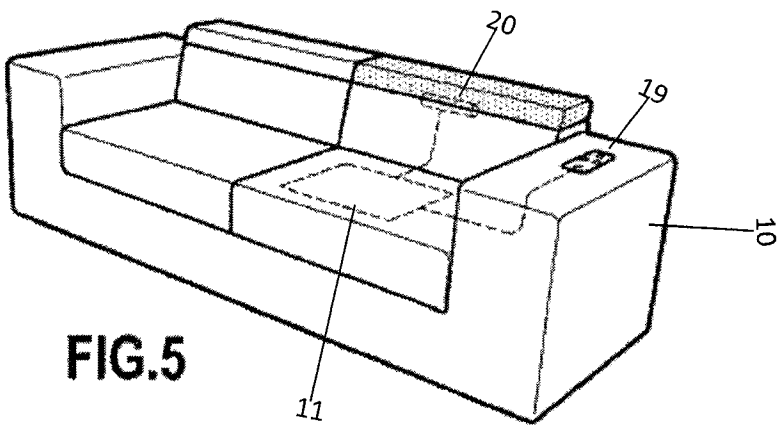
FIG. 5 is a view in perspective of the sofa in FIGS. 1 to 4.

FIGS. 1 to 5 represent a two-seater sofa comprising a frame 1 comprising firstly a seating part 2 on which there are placed two cushions 3 and 4 forming two seats on which one or more persons can sit, and secondly a part which forms a back 9, against which there are positioned two cushions 5 and 6 in order to support the back of the people seated respectively on the cushions 3, 4 of the seating part 2.

Figure 4:
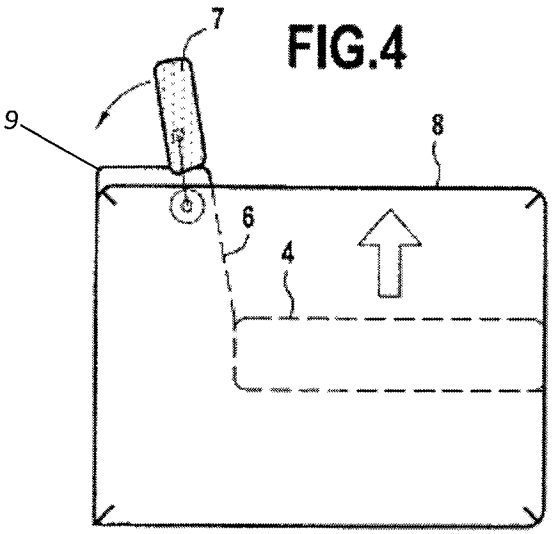
FIG. 4 is a lateral view of the seat in FIG. 3.

In addition, a headrest 7 (a single headrest is represented in the figures for the left-hand seat on the sofa, in the knowledge that a headrest can also be provided for the other seat, or a headrest common to the two seats) is fitted above the back 9, such as to be able to pivot relative to the upper edge of the latter, between a lowered position in which it is substantially horizontal, whilst resting on the upper edge of the back 9, and a raised position which is inclined upwards, in particular by an angle which may be in particular be between 0° and 120°, and preferably between approximately 40° and 60°, as represented in FIG. 4, in which it is preferably substantially in continuity with the inclination of the cushion 6 of the back.

The sofa additionally comprises two armrests 8 and 10, left and right. In the armrest 10, there is accommodated an electric system 19 for control, in particular by means of integrated circuits which are well known in the field, which system is connected to an electric motor 20 incorporated in the back, which drives the mechanical system connected to the headrest, in order to make the latter pivot between its two positions, lowered and raised, and vice versa. This system for control of the headrest by means of an electric motor is well known in the field, and is not described in greater detail hereinafter. It is foreseeable to be able to store a plurality of headrest positions according to each user, and in particular according to the weight of the user.

Between the seat 2 and the cushion 4, a pressure sensor 11 is fitted, which is designed to sense the pressure applied to the cushion 4, in particular the weight of a person who is seated on the cushion 4. This sensor system is well known in the field and is not described in greater detail. It is connected electrically to the electrical control system incorporated in the armrest. According to another, simpler embodiment, which does not comprise a control system integrated in the armrest, the system can be connected directly to the drive motor of the headrest. A combination of these two embodiments can also be provided.

In the position in which the sofa is not being used, (i.e. when there is no-one seated on the seating part), the headrest rests flat on the upper edge of the back 9 of the sofa. When someone sits on the cushion 4, the pressure sensor detects the presence of the person on the sofa, and in particular his weight. The pressure sensor then transmits a signal to the electronic control system which is integrated in the armrest, by means of conductive electric wires, or by means of wireless technology, for example by means of HF waves. Upon receipt of the signal, the control system activates the motor, so that it drives the mechanical system connected to the headrest, in order to bring the headrest into the raised position in which it supports the head of the user seated on the seating part.

When the person leaves the sofa, the pressure sensor detects this fact, and, for example, either immediately or after a certain interval of time determined in advance, transmits a corresponding signal to the electronic control system, which then activates the motor so that the latter drives the headrest in the other direction, in order to bring it into the position in which it is lowered against the upper edge of the back.

Thus, the system according to the invention is particularly simple to use, since the user no longer needs to take action, either manually on the headrest, or by pressing buttons, in order to position the headrest when he sits on the sofa, with the headrest going into the head support position by itself, without the user needing to do anything. In addition, when the user leaves the sofa, he now no longer needs to return the headrest to the lowered position, which he would often tend to forget to do in the systems according to the prior art, and with this taking a lot of time. Consequently, during its service life, the headrest is in the lowered position more often, which position is preferable in order for the service life of the mechanical drive system of the headrest to be prolonged. In fact, in the raised position, the mechanical system is more likely to be damaged, for example by an impact.

According to a preferred embodiment of the invention, it is also possible to store pre-set positions for the raised position of the headrest in the system for electronic control of the electric motor, such that, when someone sits down, the signals transmitted by the sensor trigger the motor, so that it brings the headrest into one of the pre-recorded positions, according to the weight of the person, or into the last position stored, thus allowing each occupant of the house to have available a pre-set position of the headrest which suits him automatically.

According to yet another embodiment, it is also possible to provide means which stop the motor automatically and thus the rotation of the headrest, when the headrest comes into contact with the head of the user, in order thus to assume its final raised position.

According to one embodiment, the mechanical system which is connected to the headrest appears on the exterior only in the raised position of the headrest.

According to another embodiment, the mechanical system which is connected to the headrest does not appear on the exterior in any of the positions of the headrest.

Figure 6:
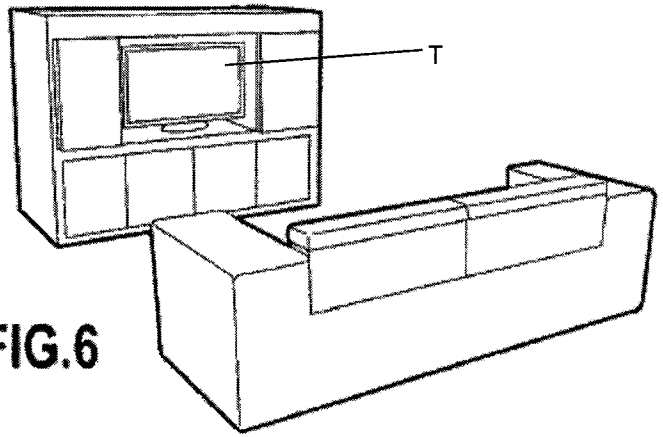
FIG. 6 is a view in perspective representing an assembly according to the invention, comprising a sofa and a television, placed such as to be watched from the sofa.

FIG. 6 shows the sofa in FIG. 1 in combination with an element spaced from the sofa, i.e. a television T. When the presence sensor detects the presence of a person seated on the seating part, it transmits a signal to the electronic system for control of the television switch, preferably by means of wireless technology, and in particular HF. Upon receipt of the signal, the electronic control system makes the switch, which is initially in its closed position (television off), go to its open position (television on). This therefore provides an assembly which is particularly simple to use. It is possible to envisage any other assembly of the same type, i.e. firstly a piece of furniture on which someone sits or stretches himself out, and secondly an element which then assumes a position or a state of use which is different from that of its standby position or state. Similarly, when the sensor detects the absence of a person at the end of a certain time determined in advance, and which can be adjusted at the choice of the user, the sensor transmits a signal to the electronic system, in order to return the television to its previous switched off state.

Thus, the system according to the invention is particularly simple to use, since the user no longer needs to take action, either manually on the television, or by pressing buttons, in order to switch the television on when he sits on the sofa, since the television switches itself on without the user needing to do anything. In addition, when the user leaves the sofa, nor does he need to switch the television off, which he would often tend to forget to do in systems according to the prior art, and with this taking a lot of time. Consequently, during its service life, the television is in the switched-off state more often, which state is preferable in order for its service life to be prolonged.

What is claimed is:

1. A piece of furniture which is used to sit on comprising at least a seating part and at least one element, distinct from said seating part, which can go between a position of use of said at least one element and a position of non-use and a control means designed to command a passage of the said at least one element from one position to another wherein:

sensor means are provided to detect the presence of a person seated on the seating part;

the control means configured to command a passage of said at least one element from one position to another when said sensor means detects the presence of the person on the seating part; and said at least one element is a headrest designed to support a head of the person seated on the seating part; the headrest being fitted such as to be able to go between at least one lowered position in which the head of the person seated cannot be supported by the headrest and one raised position in which the head of the person seated is supported by the headrest.

2. The piece of furniture according to claim 1 wherein the sensor means comprises a pressure sensor.

3. The piece of furniture according to claim 2, wherein several pre-recorded positions of said at least one element are pre-recorded according to a plurality of weights, and the control means is configured to command a displacement of the at least one element into one of the pre-recorded positions according to the weight detected by the pressure sensor.

4. The piece of furniture according to claim 1 wherein the sensor means are placed in the seating part.

5. The piece of furniture according to claim 1 wherein a mechanical system connected to the headrest appears only in the raised position of the headrest.

6. The piece of furniture according to claim 1 wherein a mechanical system connected to the headrest appears in none of the positions of the headrest.

7. The piece of furniture of claim 1, wherein the piece of furniture is a sofa.

8. A piece of furniture which is used to sit on comprising at least a seating part and at least one element, distinct from said seating part, which can go between a position of use of said at least one element and a position of non-use and a control means designed to command a passage of the said at least one element from one position to another wherein:

sensor means are provided to detect the presence of a person seated on the seating part;

the control means configured to command a passage of said at least one element from one position to another when said sensor means detects the presence of the person on the seating part; and wherein the furniture is configured such that when the sensor means does not detect the person seated on the seating part, for at least a certain interval of time determined in advance, the control means commands the passage of the at least one element into said position of non-use.

9. The piece of furniture of claim 8, wherein the piece of furniture is a sofa.

10. An assembly comprising a piece of furniture which is used to sit on comprising at least a seating part and at least one element, distinct from the piece of furniture, which can go from one position to another under the control of a control means wherein:

sensor means are provided for detecting a presence of a person seated on the seating part; and the control means configured to command a passage of said at least one element from one position to another when the sensor means detect the presence of the person on the seating part; and the assembly is configured such that when the sensor means does not detect the person seated on the seating part, for at least a certain interval of time determined in advance, the control means commands the passage of the at least one element into one of the positions.

11. The assembly according to claim 10 wherein the sensor means comprises a pressure sensor.

12. The assembly according to claim 11, wherein the sensor means are placed in the seating part.

13. The assembly according to claim 10 wherein several pre-recorded positions of said at least one element are pre-recorded according to a plurality of weights and the control means is configured to command a displacement of said at least one element into one of the pre-recorded positions according to the weight detected by the pressure sensor.

14. The assembly of claim 10, wherein the piece of furniture is a sofa.

* * * * *